US006805165B2

(12) United States Patent
Lin

(10) Patent No.: US 6,805,165 B2
(45) Date of Patent: Oct. 19, 2004

(54) ADJUSTABLE AIR STREAM INTRODUCING DEVICE

(76) Inventor: Dai-You Lin, No. 1069, Chung-Cheng Rd., Wu-Feng Hsiang, Taichung Hsien (TW)

( * ) Notice: Subject to any disclaimer, the term of this patent is extended or adjusted under 35 U.S.C. 154(b) by 397 days.

(21) Appl. No.: 10/138,096

(22) Filed: May 2, 2002

(65) Prior Publication Data

US 2003/0207667 A1 Nov. 6, 2003

(51) Int. Cl.[7] ..... F16K 11/074

(52) U.S. Cl. ..... 137/893; 137/605; 137/625.31; 251/286; 454/265

(58) Field of Search ..... 137/605, 893, 137/625.31, 625.3; 251/286; 454/265, 266

(56) References Cited

U.S. PATENT DOCUMENTS 159,142 A * 1/1875 Baird ..... 137/893
733,091 A * 7/1903 Taylor ..... 137/893
1,192,689 A * 7/1916 Sayer ..... 137/625.31
1,592,471 A * 7/1926 Smolensky ..... 137/625.31
1,849,623 A * 3/1932 Herwig ..... 137/625.31
2,261,531 A * 11/1941 Thomas ..... 137/893
2,443,071 A * 6/1948 Honerkamp et al. ..... 137/625.3
4,516,606 A * 5/1985 Worley ..... 137/625.3

* cited by examiner

*Primary Examiner*—Stephen M. Hepperle
(74) *Attorney, Agent, or Firm*—Hoffmann & Baron, LLP

(57) ABSTRACT

An adjustable air stream introducing device for reinforcement of a blowing power of a primary air stream flowing through a duct, includes a tubular coupler disposed downstream of the duct to confine an annular space. A surrounding seat member is disposed securely in the annular space, and has a plurality of internal ports angularly displaced from one another. A surrounding sash member has a plurality of external ports, and overlies on and is turnable relative to the seat member via a motor-driven actuator member so as to adjust the overlying areas of the external and internal ports, thereby adjusting the amount of the introduced air stream through the annular space.

6 Claims, 9 Drawing Sheets

ADJUSTABLE AIR STREAM INTRODUCING DEVICE

BACKGROUND OF THE INVENTION

1. Field of the Invention

This invention relates to an adjustable air stream introducing device, more particularly to an adjustable air stream introducing device for reinforcement of a blowing power of a primary air stream flowing through a duct.

2. Description of the Related Art

A conventional tubular coupler for reinforcement of a blowing or cooling power of a primary or dry air stream flowing through a duct, generally has an inner surrounding wall which includes a proximate surrounding segment that surrounds and that is distant from an output port of the duct radially with an annular space therebetween for introducing the air stream. It is desirable to have a device for adjusting the amount of air stream introduced into the tubular coupler to suit the user's requirements.

SUMMARY OF THE INVENTION

The object of the present invention is to provide an adjustable air stream introducing device for reinforcement of a blowing power of a primary air stream flowing through a duct.

According to this invention, the adjustable air stream introducing device includes a tubular coupler with an inner surrounding wall which surrounds an axis and which confines a conduit adapted to be disposed downstream of a duct. The inner surrounding wall includes proximate and distal surrounding segments relative to a surrounding end portion of the duct. The proximate surrounding segment is adapted to surround and to be disposed distant from the surrounding end portion in radial directions with an annular space therebetween. A surrounding seat member includes a first inner peripheral edge which surrounds the axis to engage the surrounding end portion, a first outer peripheral edge which engages the proximate surrounding segment, and a surrounding seat area which is interposed between and which is integrally formed with the first inner and outer peripheral edges. The surrounding seat member has a plurality of internal ports which are disposed in the surrounding seat area to communicate with the conduit and which are angularly displaced from one another about the axis. A surrounding sash member includes a second inner peripheral edge which surrounds the axis to be disposed adjacent to the surrounding end portion, a second outer peripheral edge which is disposed adjacent to the proximate surrounding segment, and a surrounding sash area which is interposed between and which is integrally formed with the second inner and outer peripheral edges. The surrounding sash member has a plurality of external ports which are disposed in the surrounding sash area and which are angularly displaced from one another about the axis. The surrounding sash member is disposed to overlie and to be turnable relative to the surrounding seat member about the axis between a fully open position, where the external ports fully coincide with the internal ports, respectively, and a partially open position, where the external ports partly overlap the internal ports, respectively. A motor-driven actuator member is disposed to initiate rotating movement of the surrounding sash member between the fully open position and the partially open position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
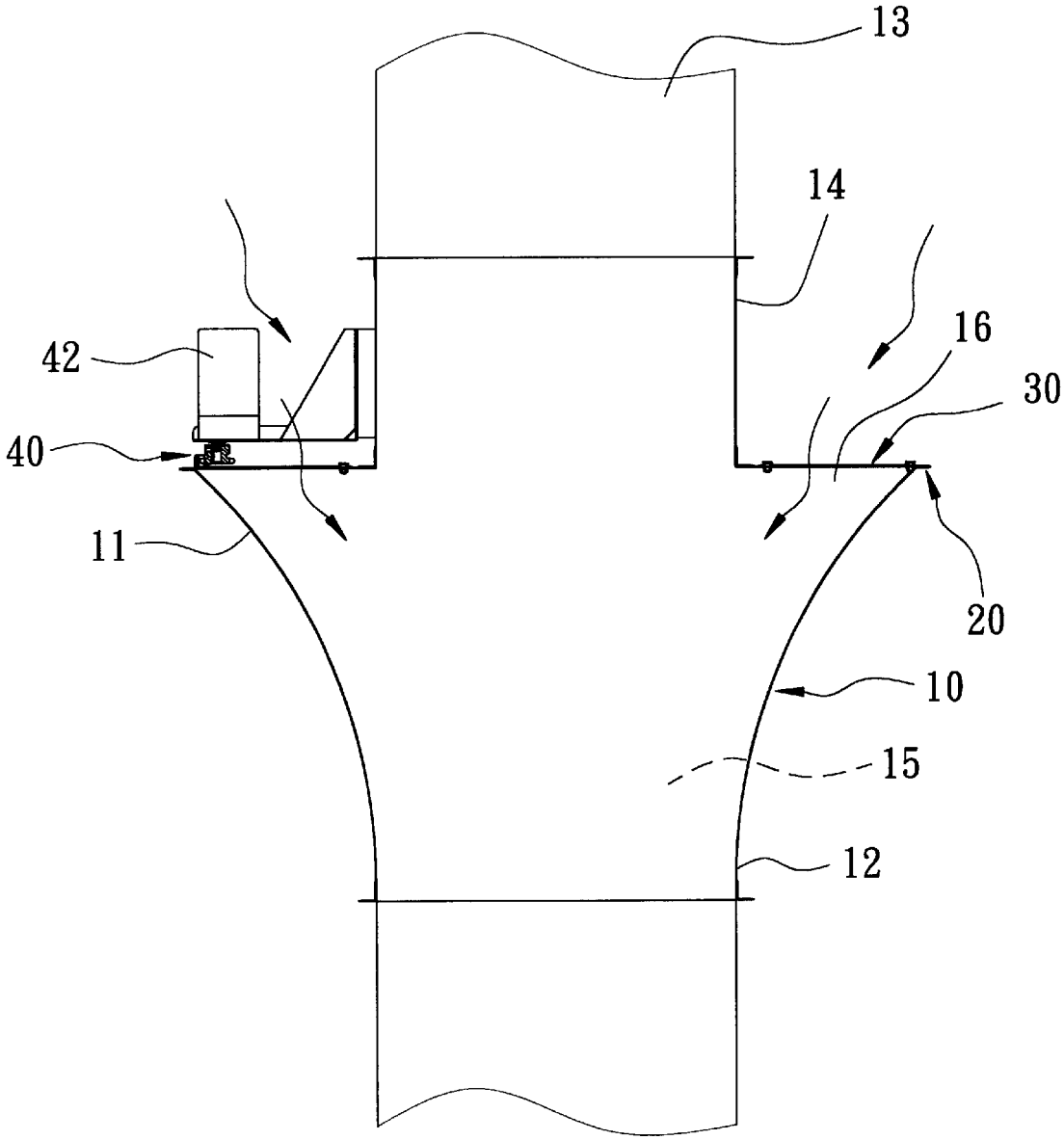
FIG. 1 is a schematic view of a preferred embodiment of an adjustable air stream introducing device according to this invention when connected to a duct.

Referring to FIG. 1, the preferred embodiment of the adjustable air stream introducing device according to the present invention is shown to comprise a tubular coupler 10, a surrounding seat member 20, a surrounding sash member 30, a motor-driven actuator member 40, and a deactivating member. The tubular coupler 10 has an inner surrounding wall which surrounds an axis and which confines a conduit 15. The inner surrounding wall includes proximate and distal surrounding segments 11,12 opposite to each other in an axial direction. The proximate surrounding segment 11 is disposed to surround and to be distal from a connecting head 14 in radial directions with an annular space 16 therebetween. The connecting head 14 is connected to a duct 13 such that a primary air stream, such as a heated or dry air stream, flows through the duct 13 and the conduit 15 towards a passage (not shown) for drying purposes.

Figure 2:
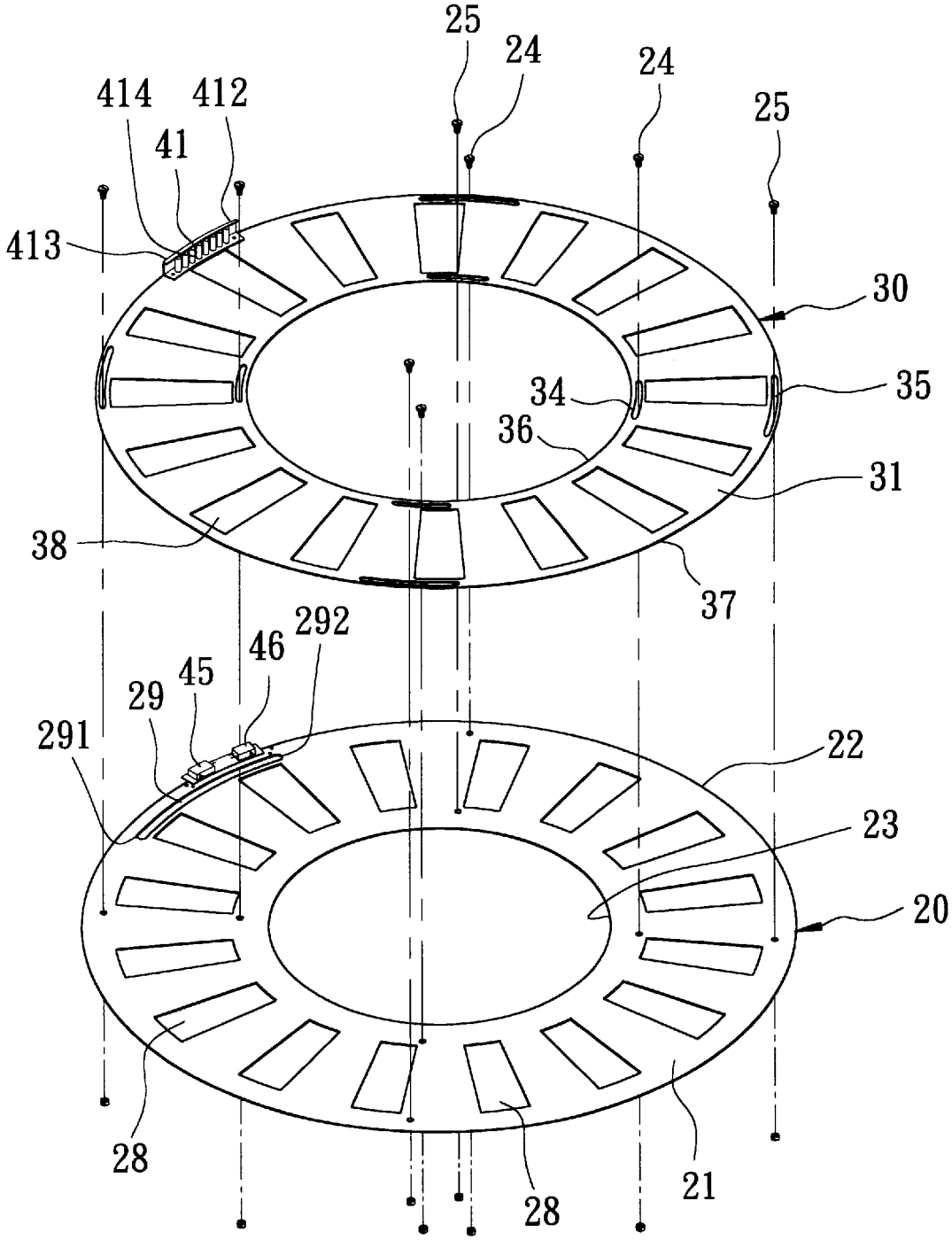
FIG. 2 is an exploded perspective view of a portion of the preferred embodiment.

With reference to FIG. 2, the surrounding seat member 20 includes a first inner peripheral edge 23 which is disposed to surround the axis to engage a surrounding end portion of the connecting head 14, a first outer peripheral edge 22 which is opposite to the first inner peripheral edge 23 in the radial directions and which engages the proximate surrounding segment 11, and a surrounding seat area 21 which is interposed between and which is integrally formed with the first inner and outer peripheral edges 23,22. The surrounding seat member 20 has a plurality of internal ports 28 which are disposed in the surrounding seat area 21 to communicate with the conduit 15, and which are angularly displaced from one another about the axis. In addition, an arcuate keyway 29, in the form of an arcuate groove, is formed in the surrounding seat area 21 and extends along the first outer peripheral edge 22 to have two terminating ends 291,292.

Figure 3:
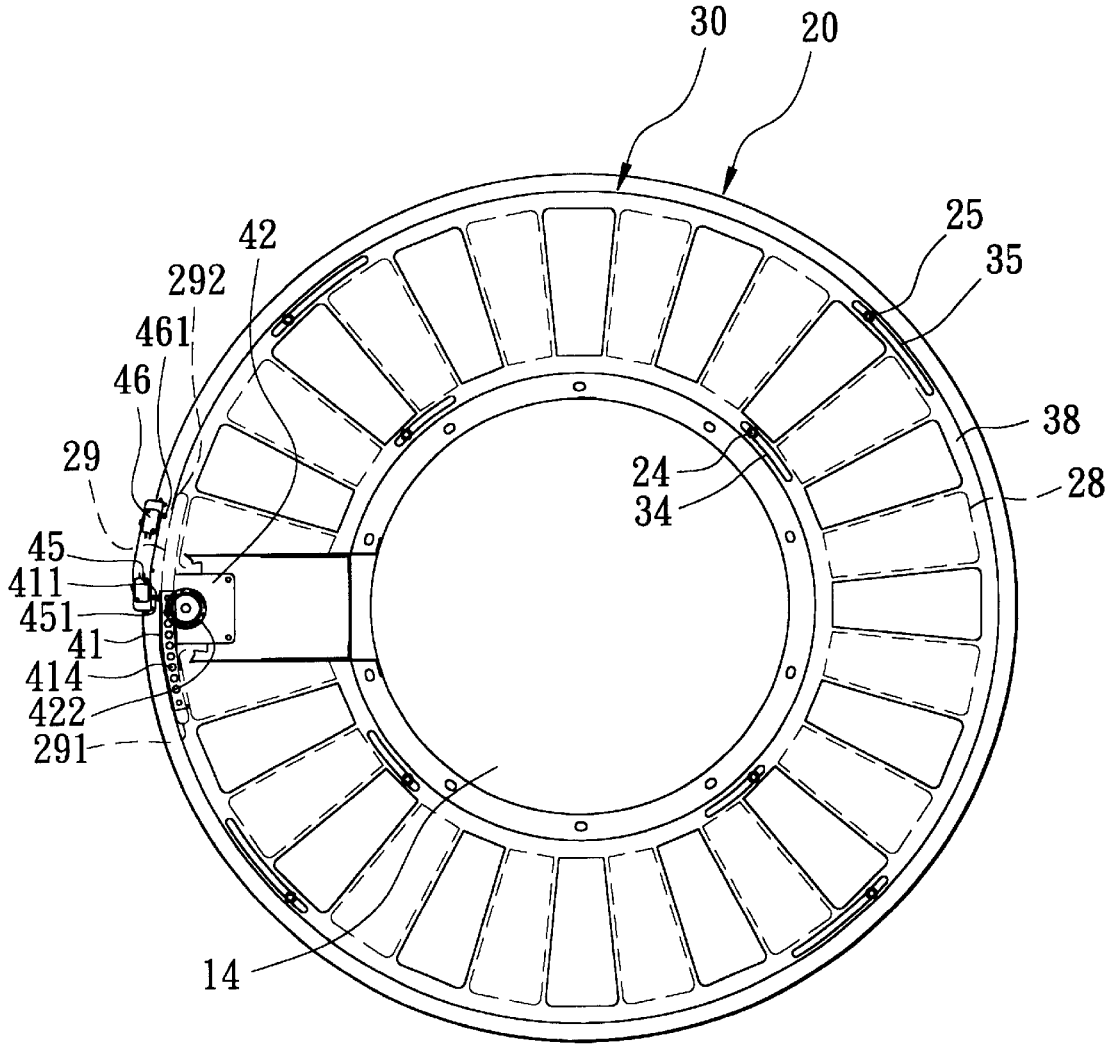
FIG. 3 is a top view of the portion shown in FIG. 2.
Figure 8:
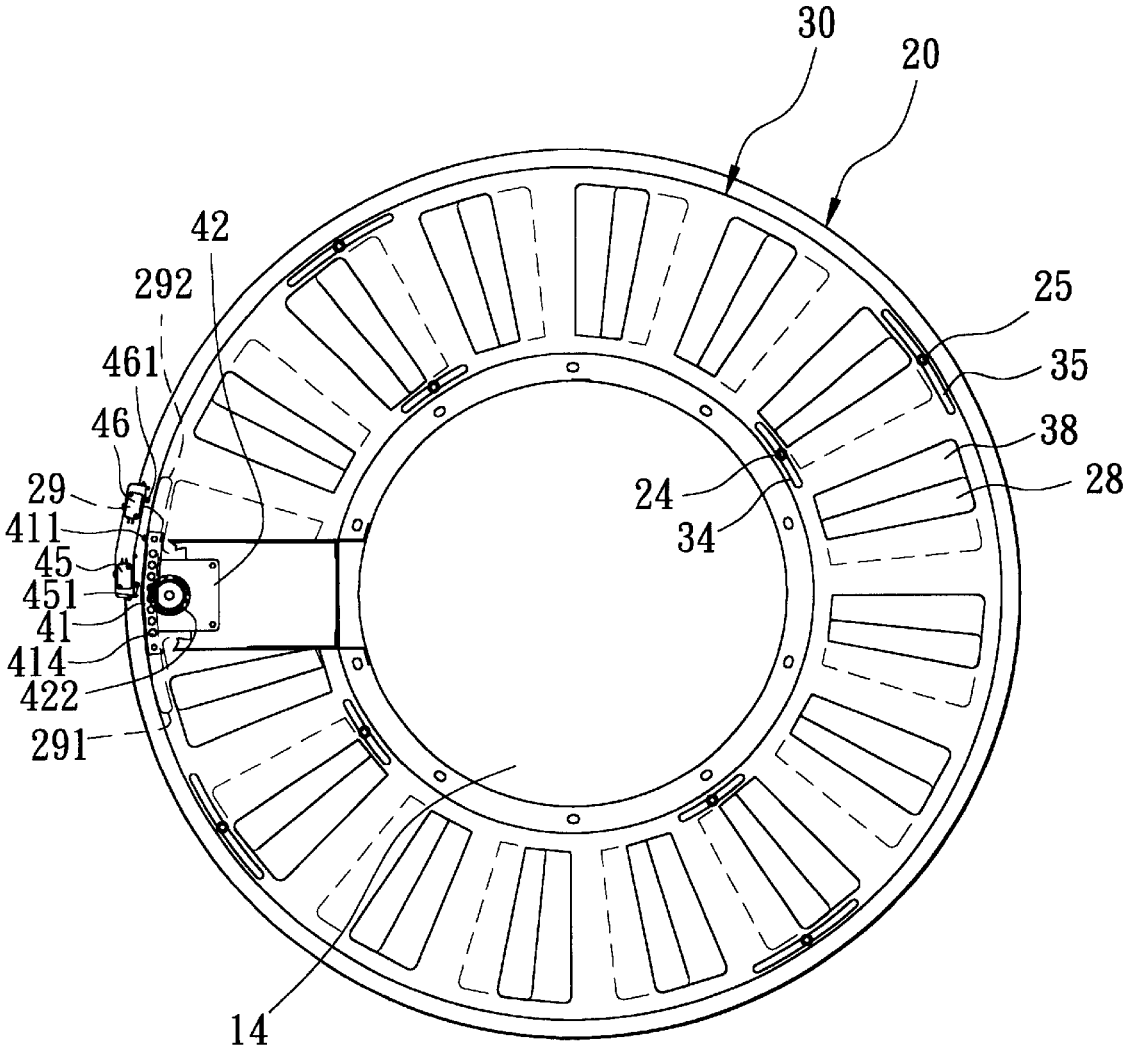
FIG. 8 is a top view similar to FIG. 3, illustrating a surrounding sash member in a partially open position.
Figure 9:
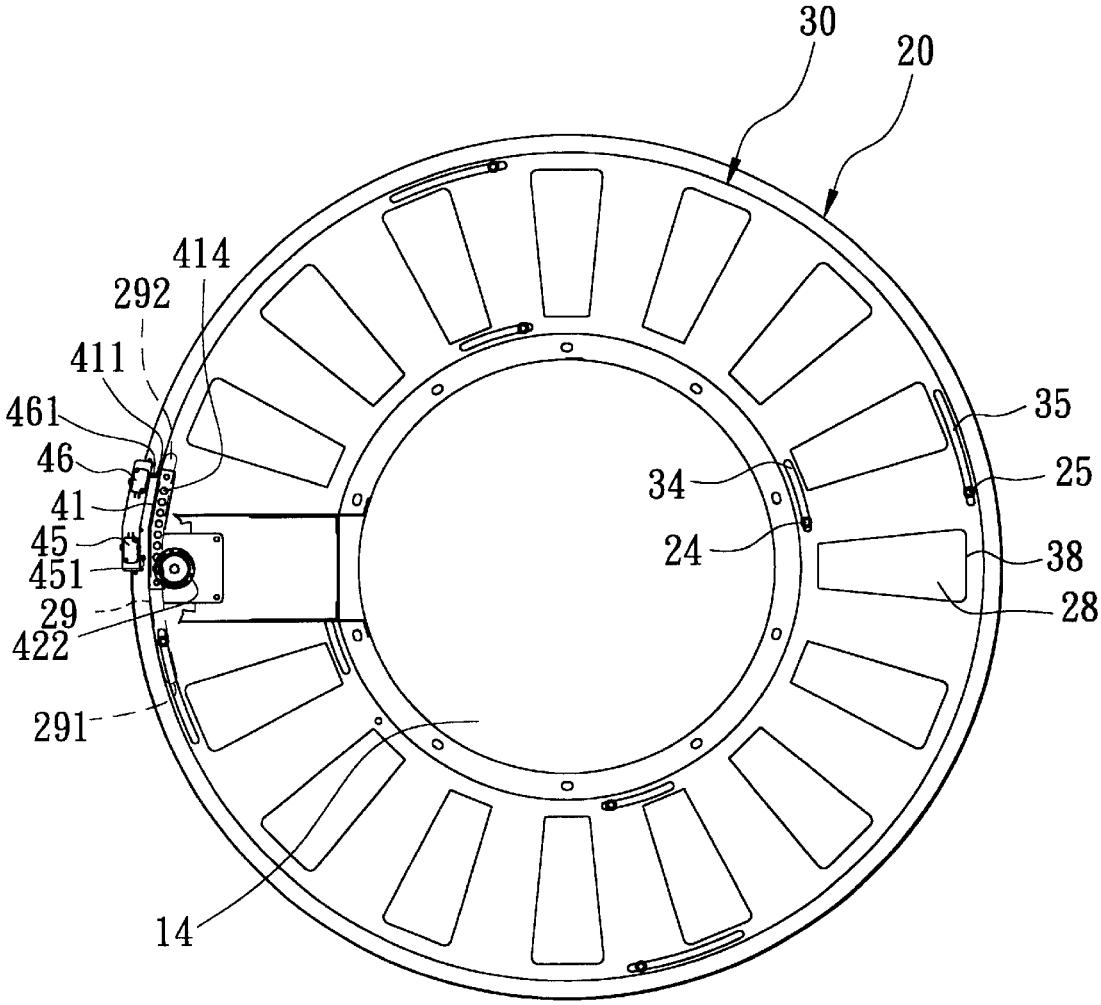
FIG. 9 is a top view illustrating the surrounding sash member in a fully open position.

The surrounding sash member 30 is disposed to overlie on the surrounding seat member 20, and includes a second inner peripheral edge 36 which is disposed to surround the axis to engage the surrounding end portion of the connecting head 14, a second outer peripheral edge 37 which is opposite to the second inner peripheral edge 36 in the radial directions and which is disposed adjacent to the proximate surrounding segment 11, and a surrounding sash area 31 which is interposed between and which is integrally formed with the second inner and outer peripheral edges 36,37. The surrounding sash member 30 has a plurality of external ports 38 which are disposed in the surrounding sash area 31, and which are angularly displaced from one another about the axis. The surrounding sash member 30 is turnable relative to the surrounding seat member 20 about the axis among a fully open position, where the external ports 38 fully coincide respectively with the internal ports 28, as shown in FIG. 9, a partially open position, where the external ports 38 partly overlap the internal ports 28, respectively, as shown in FIG. 8, and a closed position, where each external port 38 is offset from the respective internal port 28, as shown in FIG. 3. Further, with reference to FIG. 6, four pairs of arcuate grooves 34,35 are formed in the surrounding sash area 31 adjacent to the second inner and outer peripheral edges 36,37 for passage of four pairs of stems 24,25 which are secured to the surrounding seat member 20 such that the stems 24,25 are movable along the respective grooves 34,35 when the surrounding sash member 30 is rotated relative to the surrounding seat member 20.

Figure 4:
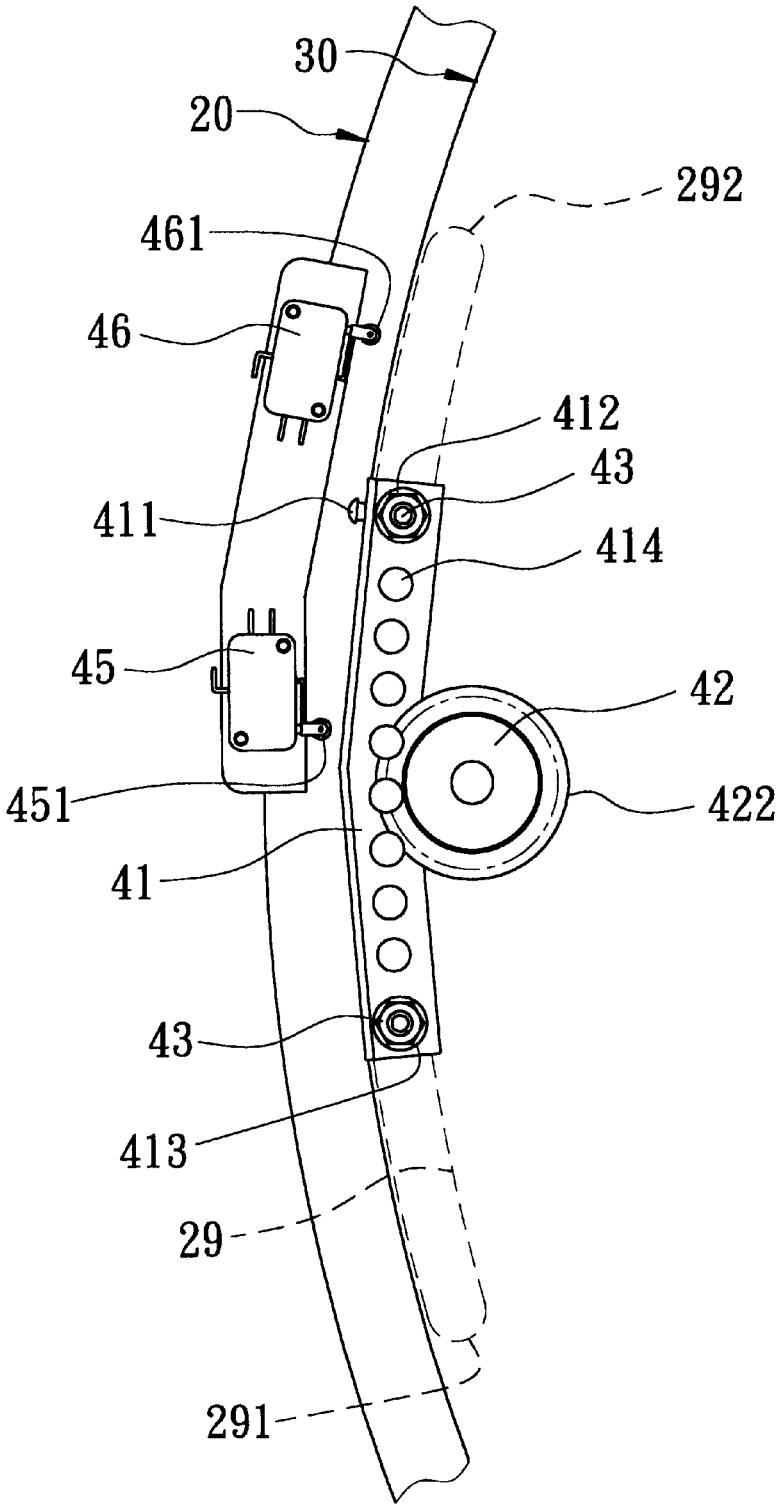
FIG. 4 is an enlarged top view showing a motor-driven actuator and a deactivating member of the preferred embodiment.
Figure 5:
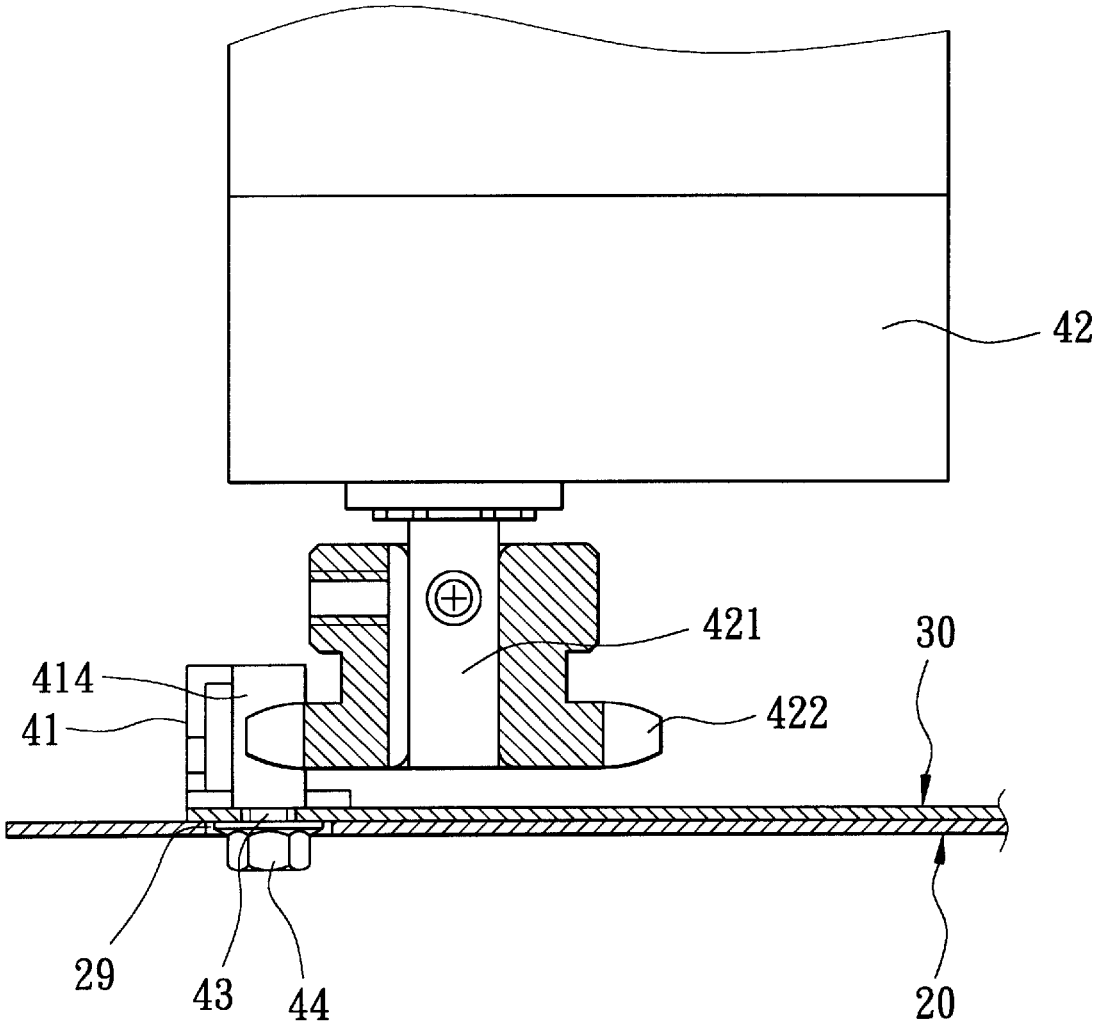
FIG. 5 is a partly sectional schematic view showing a gear mechanism of the preferred embodiment.

As shown in FIGS. 3 to 5, the motor-driven actuator member 40 includes a motor 42 which is disposed on the tubular coupler 10 and which has an output shaft 421 that extends in the axial direction. An arcuate rack 41 is secured on the surrounding sash area 31 adjacent to the second outer peripheral edge 37 and has a plurality of teeth 414. A pinion 422 is mounted on and is driven by the output shaft 421 to mesh with the teeth 414 so as to initiate rotating movement of the surrounding sash member 30 about the axis.

Figure 7:
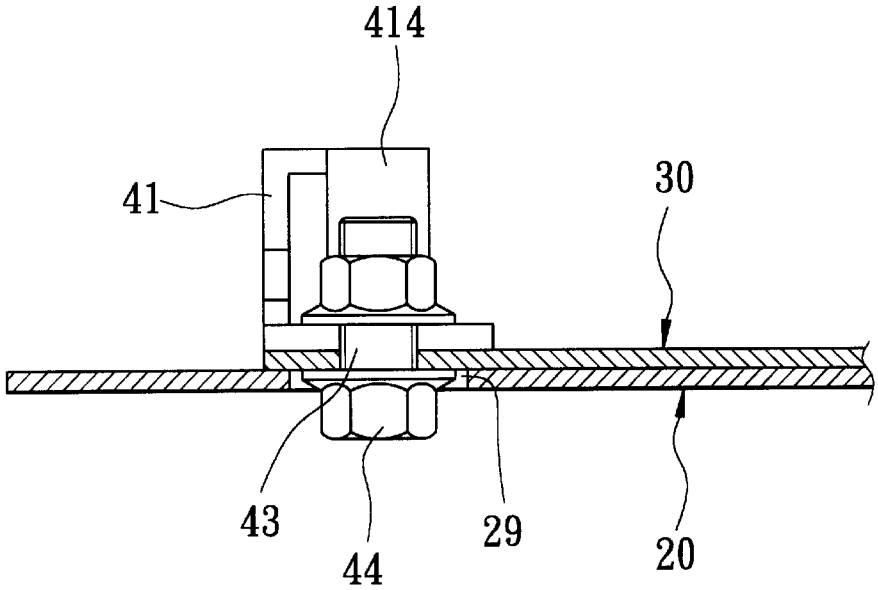
FIG. 7 is a sectional view showing another guiding member of the preferred embodiment.

As shown in FIGS. 4, 5 and 7, two screw bolts 43, which serve as two keys, pass through two ends 412,413 of the rack 41 and the keyway 29 and engage threadedly two screw nuts 44 so as to secure the rack 41 on the surrounding sash member 30. Further, the screw bolts 43 are movable along the keyway 29 so as to guide the rotating movement of the surrounding sash member 30.

As shown in FIG. 4, the deactivating member includes a contact portion 411 which is disposed on the rack 41 adjacent to the end 412. First and second microswitches 46,45 are mounted on the surrounding seat area 21 adjacent to the second outer peripheral edge 22, and respectively have first and second contact points 461,451.

In the state shown in FIG. 3, the surrounding sash member 30 is in the closed position, and the second point 451 contacts the contact portion 411 to transmit a signal so as to stop the operation of the motor 42.

Figure 6:
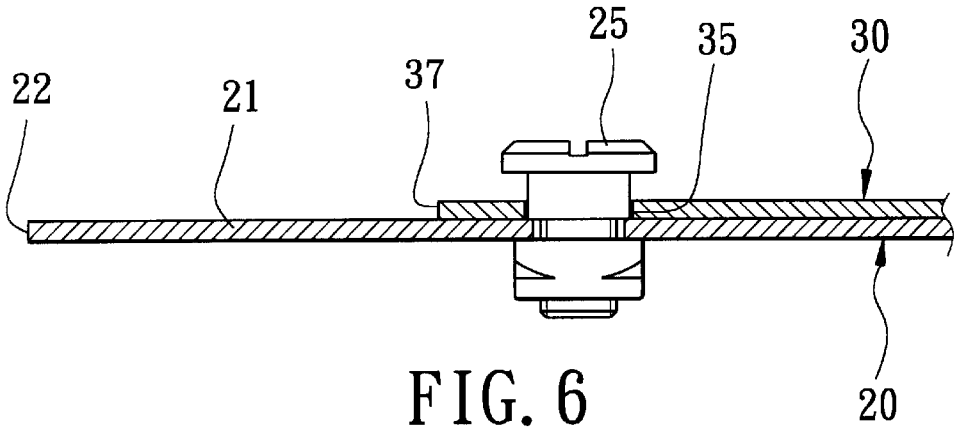
FIG. 6 is a sectional view showing a guiding member of the preferred embodiment.

As shown in FIGS. 6 and 9, the motor 42 can be actuated to rotate the pinion 422 so as to rotate the surrounding sash member 30 from the closed position to the fully open position. The motor 42 will be stopped when the surrounding sash member 30 is in the fully open position due to a signal transmitted upon contact of the contact portion 411 with the first point 461.

Therefore, by controlling the overlying areas between the external and internal ports 38,28, the amount of air stream introducing through the annular space 16 can be adjusted for mixing with a heated air stream in the tubular coupler 10.

Figure 10:
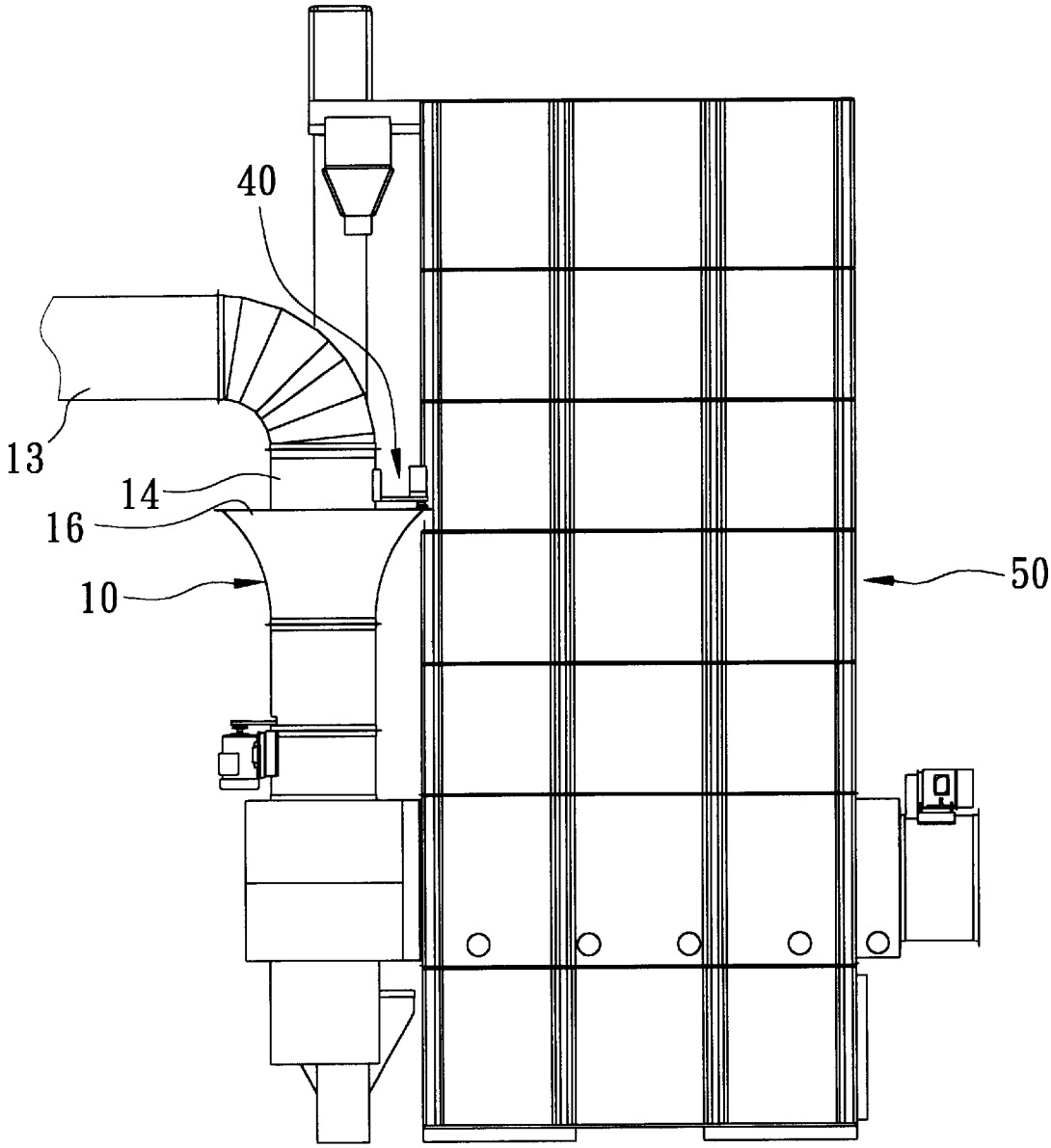
FIG. 10 is a schematic view of the preferred embodiment when incorporated in a forage blower.

Referring to FIG. 10, the adjustable air stream introducing device according to this invention can be applied to a known forage blower 50. The tubular coupler 10 is connected to a primary tube (not shown) of the forage blower 50. Air stream is introduced from the annular space 16 into the coupler 10 to mix with heated air stream from the duct 13 so as to adjust the temperature of the air stream in the blower 50.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An adjustable air stream introducing device for reinforcement of a blowing power of a primary air stream flowing through a duct which is confined by a tubular wall, the tubular wall including a surrounding end portion to define an outlet port for delivering the primary air stream, said adjustable air stream introducing device comprising:

a tubular coupler having an inner surrounding wall which surrounds an axis and which confines a conduit adapted to be disposed downstream of the duct, said inner surrounding wall including proximate and distal surrounding segments relative to the surrounding end portion, said proximate surrounding segment being adapted to surround and to be disposed distant from the surrounding end portion in radial directions with an annular space therebetween;

a surrounding seat member including a first inner peripheral edge disposed to surround the axis and adapted to engage the surrounding end portion, a first outer peripheral edge which is opposite to said first inner peripheral edge in the radial directions and which is disposed to engage said proximate surrounding segment, and a surrounding seat area interposed between and integrally formed with said first inner and outer peripheral edges, said surrounding seat member having a plurality of internal ports which are disposed in said surrounding seat area to communicate with said conduit and which are angularly displaced from one another about the axis;

a surrounding sash member including a second inner peripheral edge disposed to surround the axis and adapted to be disposed adjacent to the surrounding end portion, a second outer peripheral edge which is opposite to said second inner peripheral edge in the radial directions and which is disposed adjacent to said proximate surrounding segment, and a surrounding sash area interposed between and integrally formed with said second inner and outer peripheral edges, said surrounding sash member having a plurality of external ports which are disposed in said surrounding sash area and which are angularly displaced from one another about the axis, said surrounding sash member being disposed to overlie and to be turnable relative to said surrounding seat member about the axis between a fully open position, where said external ports fully coincide with said internal ports, respectively, and a partially open position, where said external ports partly overlap said internal ports, respectively; and a motor-driven actuator member disposed to initiate rotating movement of said surrounding sash member about the axis between the fully open position and the partially open position.

2. The device of claim 1, wherein said surrounding seat member further has an arcuate keyway disposed in said surrounding seat area and extending along said first outer peripheral edge, said surrounding sash member further having a guiding key disposed on said surrounding sash area and extending into said arcuate keyway to guide the rotating movement of said surrounding sash member.

3. The device of claim 1, wherein said motor-driven actuator includes a motor disposed on said tubular coupler and having an output shaft which extends in a direction parallel to the axis, an arcuate rack disposed on said surrounding sash area adjacent to said second outer peripheral edge, and a pinion mounted on and driven by said output shaft and disposed to mesh with said rack so as to transmit driving force of said output shaft to rotate said surrounding sash member.

4. The device of claim 3, wherein said surrounding sash member is disposed to be further turnable relative to said surrounding seat member about the axis to a closed position, where each of said external ports and a respective one of said internal ports are offset from each other.

5. The device of claim 4, further comprising a deactivating member disposed to deactivate said motor-driven actuator when said surrounding sash member reaches one of the fully open and closed positions, thereby stopping the rotating movement of said surrounding sash member.

6. The device of claim 5, wherein said deactivating member includes a contact portion disposed on and movable with said surrounding sash member, and first and second microswitches mounted on said surrounding seat area adjacent to said second outer peripheral edge, and respectively having first and second contact points which are arranged such that when said surrounding sash member is in the fully open position, said first contact point contacts said contact portion to transmit a signal so as to stop operation of said motor, and such that when said surrounding sash member is in the closed position, said second contact point contacts said contact portion to transmit a signal so as to stop the operation of said motor.

* * * * *